United States Patent [19]

Carbonnel et al.

[11] 3,961,778

[45] June 8, 1976

[54] INSTALLATION FOR THE TREATING OF A MOLTEN METAL

[75] Inventors: Henri Carbonnel, Antony; Pierre Vaury, Clamart, both of France

[73] Assignee: Groupement pour les Activites Atomiques et Avancees, Le-Plessis-Robinson, France

[22] Filed: May 28, 1974

[21] Appl. No.: 473,980

[30] Foreign Application Priority Data

May 30, 1973 France ..... 73.19774

[52] U.S. Cl. ..... 266/217; 75/93 R; 75/68 R

[51] Int. Cl.[2] ..... C22B 21/06

[58] Field of Search ..... 75/68, 93 R; 266/34 T, 266/34 PP, 34 V

[56] References Cited

UNITED STATES PATENTS

| | | | |
|---|---|---|---|
| 3,610,600 | 10/1971 | Schnake | 266/34 V |
| 3,715,112 | 2/1973 | Carbonnel | 266/34 PP X |

*Primary Examiner*—M. J. Andrews
*Attorney, Agent, or Firm*—Sughrue, Rothwell, Mion, Zinn & Macpeak

[57] ABSTRACT

Industrial treating of corrosive molten metals by a gas within molten liquid duct of a treating electromagnetic pump comprising an installation in which the input of said treating pump is connected to an ascending pump immersed in said molten metal and the output of said treating pump is connected to a degassing tank provided with a spout pouring out the treated molten metal.

9 Claims, 1 Drawing Figure

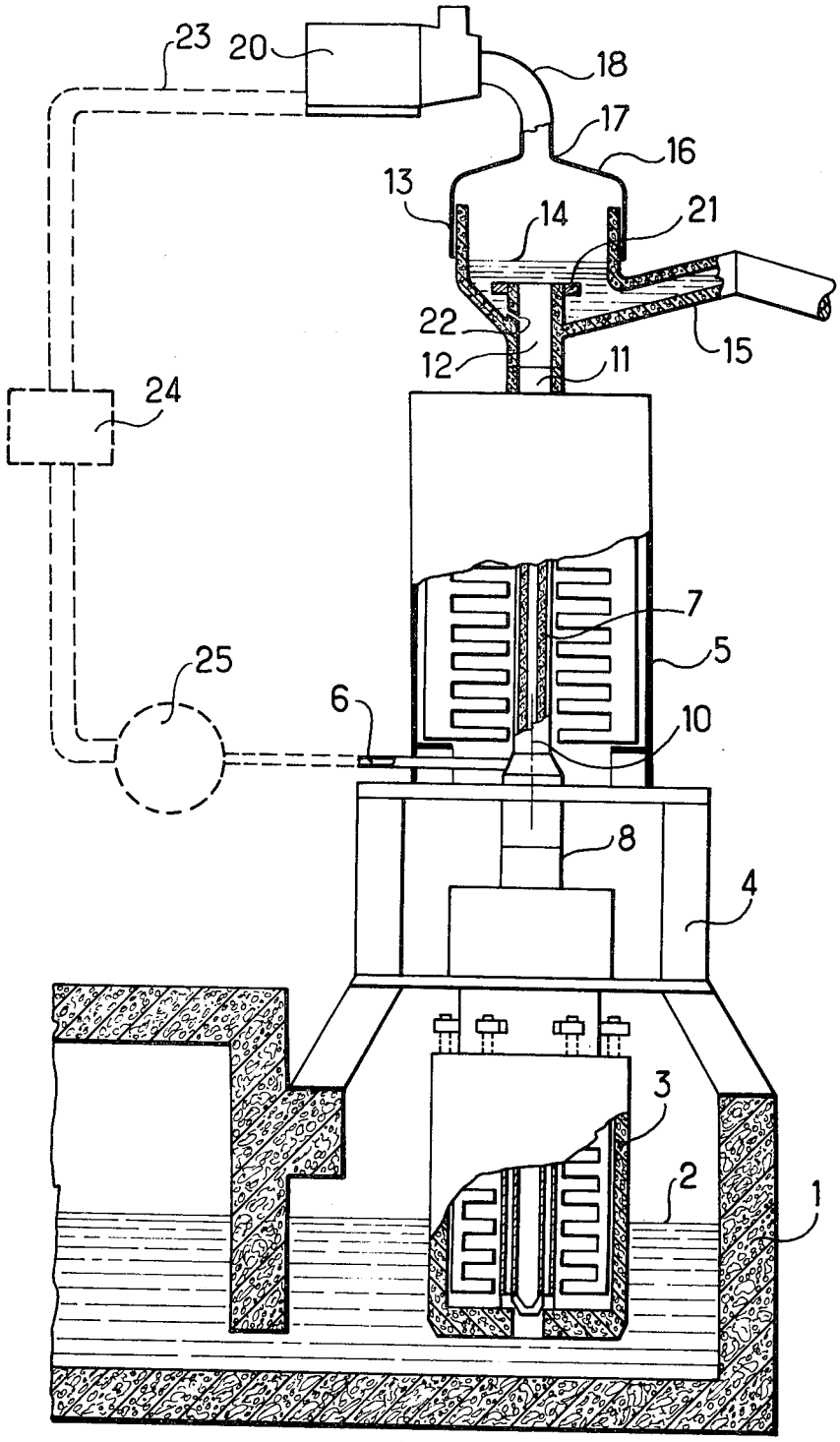
23
20
18
17
16
13
14
21
22
12
11
15
24
7
5
25
6
10
8
4
3
2
1

INSTALLATION FOR THE TREATING OF A MOLTEN METAL

BACKGROUND OF THE INVENTION

1. FIELD OF THE INVENTION

The present invention concerns an industrial method as well as an installation for the treating of a molten metal according to the said method.

2. DESCRIPTION OF THE PRIOR ART

It is known that during the past few years, various devices have been perfected for enabling the treating of molten metals by making a flux of gas such as chlorine or nitrogen bubble in the metal bath with a view to removing from that bath the impurities and the gases trapped therein.

More particularly, a device enabling the continuous treatment of molten metals by an electromagnetic pump whose duct is made of a substance having a predetermined high open porosity, has been produced. That duct is arranged inside a metallic tube which is substantially coaxial with it and which comprises sealing means.

The space comprised between the metallic tube and the duct of the pump is connected to a source of treating gas under pressure, so that the gas entering the metal through the duct becomes closely stirred with the impure molten metal by the currents induced by the windings of the said electromagnetic pump.

The method and the device thus implemented effectively make it possible to obtain a stirring which constitutes a very great advantage, as the currents induced by the electromagnetic pump are formed throughout the mass of the molten metal at the time when the latter crosses through the pump body.

The industrial perfectionning of that continuous treatment has nevertheless led the inventor to seek to improve even further the treatment, on the one hand, by attempting to improve the removal of the gases trapped or set free during the treatment and, on the other hand, by increasing further the amplitude of the stirring, these two operations combining to improve the method for treating the molten metal.

SUMMARY OF THE INVENTION

The object of the invention is therefore a method for the continuous industrial treating of a molten metal and more particularly of a corrosive molten metal such as aluminium by a gas within the liquid metal duct of an electromagnetic pump in which the gap comprised between the said duct made of a refractory substance having predetermined open porosity and a sealed metallic tube surrounding the said duct, is connected to the source of gas for treating under pressure, characterized in that a slight predetermined depression in relation to the atmospheric pressure is created and in that the pumping element is arranged in such a way that the latter may operate under back pressure.

The industrial implementing of the invention has led the Inventors to put, in series with the treating pump, a second pump intended to ensure an over-pressure of 0.5 bar to 2 to 3 bars of the metal, then enabling the treating pump to be made to operate under back pressure so as to increase the turbulence within the pump body; that back pressure may be maintained at a fixed value or, on the contrary, vary permanently with a suitable frequency setting up, in the pump body, the turbulence required, which is added to that caused spontaneously by the action of the induced currents in the molten metal.

Moreover, the setting up of a slight vacuum at the level of the decanting and degassing tank speeds up the removal of the gas injected at the time of the passing of the metal through the pump body, this having the effect of drawing away more completely to the surface the impurities to be removed; this depression is indeed a slight one of a few hundreds of torrs in relation to the atmospheric pressure, but not a depression intended to enable the rising of the metal; indeed, a slight depression in that order rapidly brings the impurities to the surface of the bath, whereas a greater depression causes a too energetic stirring of the impurities at the surface of the molten metal and their re-insertion in the molten metal bath. On the other hand, if no depression is set up at all, a crust is formed at the surface of the metal, making the removal of the impurities, which gather below that crust, more difficult.

BRIEF DESCRIPTION OF THE DRAWINGS

The example of embodiment described herein below has no limiting character; it is described only by way of an example of a particular embodiment.

FIG. 1 is a diagrammatic cut away view of such an installation.

DESCRIPTION OF THE PREFERRED EMBODIMENT

Referring to that FIGURE, 1 is an aluminium furnace, the level of the molten metal being shown at 2, an immersed ascending pump for molten metals may be distinguished at 3, in the furnace bathing in the molten metal. In the case shown by the example, the pump used is an annular induction pump capable of providing an overpressure comprised between 0.5 and 2 bars, this corresponding substantially to a column of liquid aluminium respectively comprised between 2 meters and 8 meters.

Above the immersed pump, on a support 4, the treatment pump 5, already known per se, is arranged; that pump is a flat induction pump whose treating gas inlet passage may be distinguished at 6; nevertheless, the treatment pump is provided with two stators, in order to increase the stirring currents.

It will observed that the molten metal duct in the treating pump 5 has been arranged in the extension of the outlet duct 8 of the over-pressure pump 3 in order to avoid any useless loss of head. The treating of the molten metal is effected within the duct of the treating pump between the points 10 and 11 corresponding respectively to the input and to the output of the pump. The output 11 of the pump is extended by a vertical passage 12 leading to the decanting and degassing tank 13. At its upper part, the vertical passage 12 is surrounded by an annular rim enabling the molten metal to be removed towards the periphery of the decanting tank 13 in a slight thickness making the degassing of the molten metal easier. Drawing the molten metal from below the level 14 into the decanting tank 13, a spout 15 enables the removal of the treated molten metal as it arrives in the decanting tank 13. That tank is covered with a sealed removable cowl 16 extended at its top 17 by a passage 18 ending up at a high-discharge pump 20. As has been set forth above, that pump must not provide too great a lowering of pressure which would lead to a too rapid discharge removal of the treating gas. In this way, the pump installed in the example described hereinabove is an air horn of a known type.

The treating gas injected by the duct 6 is nitrogen, in the example of embodiment.

An opening 22 is provided in the passage 12 at its output in the decanting tank 13.

When the decantation products take up, at the surface 14 of the molten metal, too great a volume, it is quite possible to lift the removable cowl 16 and to extract these decantation products without interrupting the operation of the device because of the slight lowering of pressure caused by the air horn at the surface 14 of the molten metal.

When it is required to improve the degree of purity of the metal obtained or to ensure that no gas such as hydrogen, for example, remains in the trapped state or dissolved state in the liquid metal, it may be an advantage to increase the pressure provided by the immersed ascending pump 2 and to make the treating pump 5 operate under back-pressure. According to the case, it may be an advantage to make the pump 5 operate under constant back-pressure or on the contrary to make that counter-pressure modulate at a suitable rhythm making it possible at all times to displace the turbulances which are formed under the action of the counter-pressure.

In the case where it is required to scavenge the treating gas, the air horn 20 is replaced by a vacuum pump of the conventional type whose output 23 is connected through oil filters and hydrogen traps 24 to the input 6 of the treating pump through a fan 25.

Although the method and device which have just been described appear to afford the greatest advantages for the implementing of the invention, it will be easily understood that various modifications may be made thereto without going beyond the scope of the invention, it being possible, more particularly, to replace certain phases of the method by other operations capable of fulfilling the same technical function or an equivalent technical function therein; lastly, certain phases of the method may even simply be dispensed with in certain particular cases.

What is claimed is:

1. An installation for the industrial treating of a molten metal comprising in combination:

a furnace for holding said liquid metal, a duct mounted on said furnace and extending upwardly therefrom and formed of a refractory substance having a predetermined porosity, a sealed metallic tube surrounding said duct, spaced therefrom and connected to a source of treatment gas under pressure, a liquid metal ascending pump immersed in said molten metal below said duct and operatively coupled thereto for forcing under pressure molten metal through said duct for treatment by said gas, said duct being connected at its upper end to a decanting and degassing tank, an electromagnetic treating pump mounted above said furnace and surrounding said duct for carrying the molten metal for providing a pumping force acting in opposition to that of said liquid metal ascending pump, the capacity of said liquid metal ascending pump being such that when liquid metal is forced upwardly through said duct, a back pressure is exerted by said electromagnetic treating pump to provide turbulence and metal is discharged from said duct into said decanting and degassing tank under pressure, and said installation further comprising a treatment gas high-discharge pump at the upper end of said decanting and degassing tank for lowering the pressure of the treatment gas within said decanting and degassing tank after gas treatment of the metal.

2. The installation for treating molten metal according to claim 1, wherein the inlet passage for feeding the molten metal of the treating pump to the decanting tank is coaxial at its input with an annular rim defining the output of the treating pump.

3. The installation for the industrial treating of a molten metal according to claim 1 wherein the immersed pump is an electromagnetic pump.

4. The installation for the industrial treating of a molten metal according to claim 3, wherein the immersed electromagnetic pump is an annular induction pump.

5. The installation for the industrial treating of a molten metal according to claim 3, wherein the treating pump is an induction pump.

6. The installation for the industrial treating of a molten metal according to claim 5, wherein the treating pump is an induction pump having two stators.

7. The installation for the industrial treating of a molten metal according to claim 5 wherein the decanting and degassing tank arranged at the out-put of the treating pump is covered with a removable sealed cowl connected to said gas high-discharge pump.

8. The installation for the industrial treating of a molten metal according to claim 7, wherein the decanting and degassing tank arranged at the output of the treating pump is provided with a spout for pouring out the treated molten metal.

9. The installation for treating molten metal according to claim 3, wherein the immersed electromagnetic pump is a conduction pump.

* * * * *